US007419324B2

(12) United States Patent
Whaley

(10) Patent No.: US 7,419,324 B2
(45) Date of Patent: Sep. 2, 2008

(54) BINDER METAL WITH SHIELD INSERT

(75) Inventor: Paul A. Whaley, Herculaneum, MO (US)

(73) Assignee: U.S. Ring Binder, L.P., St. Louis, MO (US)

( * ) Notice: Subject to any disclaimer, the term of this patent is extended or adjusted under 35 U.S.C. 154(b) by 534 days.

(21) Appl. No.: 11/119,634

(22) Filed: May 2, 2005

(65) Prior Publication Data

US 2006/0245821 A1 Nov. 2, 2006

(51) Int. Cl.
*B42F 3/00* (2006.01)
*B42F 13/00* (2006.01)

(52) U.S. Cl. ..... 402/4; 402/80 R

(58) Field of Classification Search ..... 402/1, 402/4, 26, 31, 34, 36–39, 41, 502
See application file for complete search history.

(56) References Cited

U.S. PATENT DOCUMENTS

| | | | | |
|---|---|---|---|---|
| 566,717 | A | 8/1896 | Krah | |
| 651,254 | A | 6/1900 | Krah | |
| 842,851 | A | 2/1907 | Boden | |
| 924,647 | A | 6/1909 | Eddy | |
| 974,831 | A | 11/1910 | Scherzinger | |
| 1,157,154 | A | 10/1915 | Schade, Jr. | |
| 1,904,572 | A | 4/1933 | Trussell | |
| 2,068,470 | A | 1/1937 | Rezner | |
| 2,103,307 | A | 12/1937 | Unger | |
| 2,200,146 | A | 5/1940 | Block | |
| 2,364,859 | A | 12/1944 | Lichtenstein | |
| 2,644,212 | A * | 7/1953 | Markowitz | 24/11 R |
| 2,647,517 | A | 8/1953 | Bilbrey | |
| 2,821,197 | A | 1/1958 | Bilbrey | |
| 3,153,417 | A | 10/1964 | Newman | |
| 3,995,961 | A | 12/1976 | Dorfman | |
| 4,295,747 | A | 10/1981 | Errichiello | |
| 4,566,817 | A | 1/1986 | Barrett, Jr. | |
| 4,571,108 | A | 2/1986 | Vogl | |
| 4,820,071 | A | 4/1989 | Steinfield et al. | |
| 5,116,081 | A | 5/1992 | Mann, Jr. | |
| 5,120,149 | A | 6/1992 | Smith | |
| 5,388,306 | A | 2/1995 | Bedol | |
| 5,570,964 | A | 11/1996 | Bedol | |
| 5,695,294 | A * | 12/1997 | Bedol et al. | 402/79 |
| D390,254 | S | 2/1998 | Bedol | |
| 5,820,095 | A * | 10/1998 | Stone | 248/316.7 |
| 6,113,297 | A | 9/2000 | Kovacik | |
| 6,382,863 | B1 | 5/2002 | To et al. | |
| D486,523 | S * | 2/2004 | Lederer et al. | D19/83 |
| 2003/0103796 | A1 * | 6/2003 | To et al. | 402/38 |
| 2003/0103798 | A1 * | 6/2003 | Cheng et al. | 402/73 |

* cited by examiner

*Primary Examiner*—Derris H. Banks
*Assistant Examiner*—Pradeep C Battula
(74) *Attorney, Agent, or Firm*—Polster, Lieder, Woodruff & Lucchesi, LC

(57) ABSTRACT

An improved ring shield (10) with an insert (40) for an accessory (44). The ring shield (10) includes a fastener (66) which removably attaches the insert (40) to the ring shield (10). The fastener (66) removably attaches the insert to the ring shield (10) such that the bottom of the insert (40) planarly abuts against the top of the ring shield (10).

13 Claims, 4 Drawing Sheets

BINDER METAL WITH SHIELD INSERT

CROSS REFERENCE TO RELATED APPLICATIONS

None

STATEMENT REGARDING FEDERALLY SPONSORED RESEARCH OR DEVELOPMENT

N/A

BACKGROUND OF THE INVENTION

The present invention relates to a ring shield for positioning an accessory within binder rings and the like, and more particularly, a ring shield which positions an accessory having a variety of forms in a convenient position while maximizing the allowed space for loose-leaf sheets within the binder rings.

Binder metal or ring metal is a generic name for a paper holding device by which hole-punched sheets of paper are stored in a ring binder. The metal typically consists of two or more binder rings each of which is formed by two ring sections which are movable apart and together to open and close the binder, a mechanism operable by the user to open and close the rings, and a metal cover or shield which covers the mechanism. The shield comprises an elongated piece of metal or plastic whose length generally corresponds to the length of the binder and the size of the sheets of paper stored in the binder, and whose width generally corresponds to the width of a spine section of the binder (the portion of the binder between the end leaves of the binder).

Conventional ring binders employ pockets or sheets that include attachments to hold accessories such as writing implements. The pockets/sheets use a flap in which holes are punched, wherein the binder rings hold the pockets/sheets in the same manner as the loose-leaf paper. Heretofore, conventional ring binders incorporate separate attachments for accessories that result in unwieldy use since the user must flip back and forth between the attachment and the loose-leaf papers. Other conventional ring binders employ accessory attachments fixed to the shield. These attachments, however, incorporate much of the space within the binder rings. As such, the efficiency of the ring binder is reduced since the binder cannot hold the designed amount of loose-leaf paper.

BRIEF SUMMARY OF THE INVENTION

The present disclosure relates to a ring shield for positioning an accessory having a variety of forms in a convenient position within binder rings while maximizing the allowed space for loose-leaf sheets within the binder rings.

In one embodiment, the ring shield comprises a plate, the length of which generally corresponds to the length of the binder ring. Additionally, the ring shield comprises an insert having a body which is combined with the accessory. A fastener removably attaches the insert to the plate such that the body bottom planarly abuts against the top of the plate.

Other features will be in part apparent and in part pointed out hereinafter.

BRIEF DESCRIPTION OF THE SEVERAL VIEWS OF THE DRAWINGS

In the accompanying drawings which form a part of the specification.

Corresponding reference characters indicate corresponding parts throughout the several views of the drawings.

DETAILED DESCRIPTION OF INVENTION

The following detailed description illustrates the invention by way of example and not by way of limitation. This description will clearly enable one skilled in the art to make and use the invention, and describes several embodiments, adaptations, variations, alternatives and uses of the invention, including what I presently believe is the best mode of carrying out the invention. As various changes could be made in the above constructions without departing from the scope of the invention, it is intended that all matter contained in the above description or shown in the accompanying drawings shall be interpreted as illustrative and not in a limiting sense.

Figure 1:
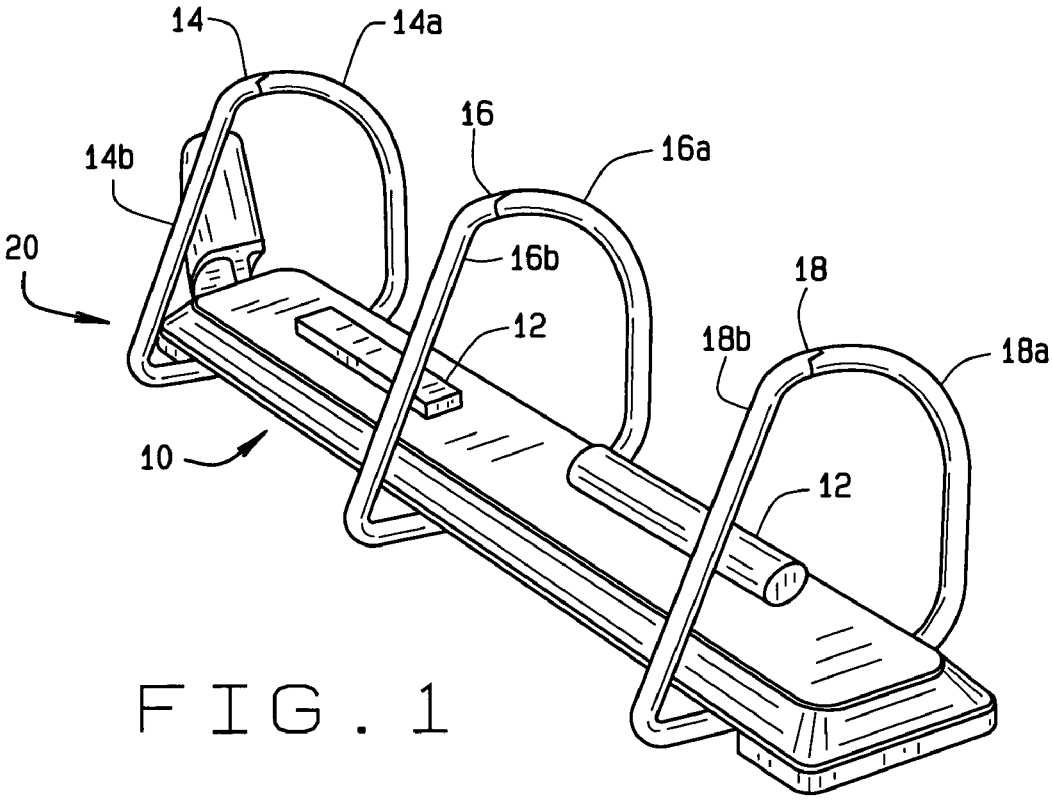
FIG. 1 is a perspective view of a ring shield of the present invention positioning an accessory within binder rings.
Figure 2:
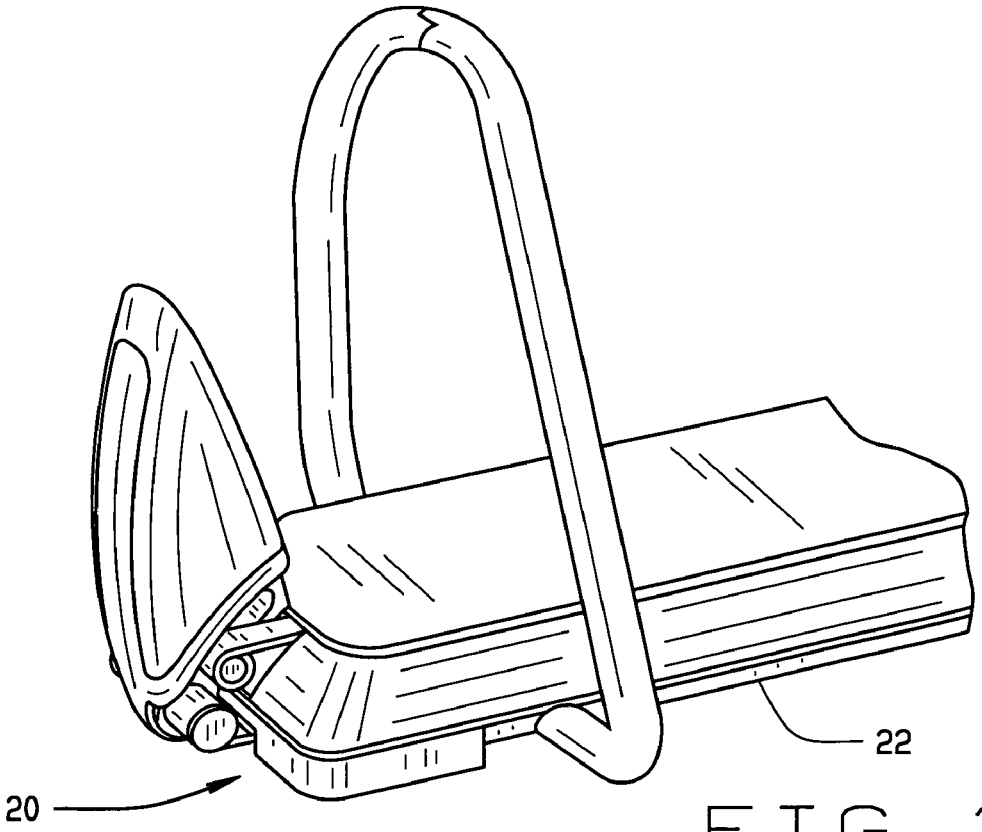
FIG. 2 is a similar perspective view looking at an end of the shield.

Referring to the drawings, an improved ring shield generally indicated 10 in FIG. 1 is for use in positioning an accessory 12 within binder rings 14, 16 and 18 of a binder metal generally shown as 20. A binder metal for use in a ring binder (not shown) is attached to the spine portion of the ring binder in a conventional manner. Although referred to as a metal, those skilled in the art will understand that binder metal 20 can be either a metal or plastic construction, or a combination thereof. The binder metal 20 includes spaced rings 14, 16 and 18 each of which is comprised of two curved ring segments 14*a*, 14*b*, 16*a*, 16*b* and 18*a*, 18*b* respectively. Rings 14 and 18 are located adjacent each end of the binder metal 20, while ring 16 is located midway the length thereof. Each ring segment has one end that is attached to a respective hinge plate 22 as shown in FIG. 2. The hinge plates 22 are each rectangular plates which extend side-by-side substantially the length of the binder metal 20. Those skilled in the art will understand that binder metal 20 could have more or fewer rings without departing from the scope of the disclosure.

Figure 3:
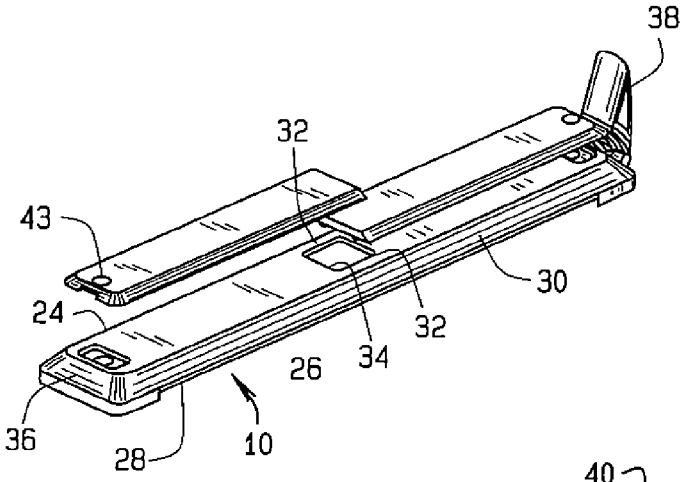
FIG. 3 is a perspective view of an insert being attached to the shield.

Turning to FIG. 3, shield 10 comprises an elongate plate indicated as 24. The length of plate 24 generally corresponds to the length of the binder (not shown). The width of plate 24 generally corresponds to the width of the binder spine. Plate 24 has a flat center top 26, a bottom 28 which may be wider and longer than the top 26 and sides 30. The top 26 further has opposing planar portions 32, and a recess portion 34 which separates planar portions 32. In one embodiment of the invention, recess portion 34 may be positioned on the top 26 at a position equidistant from ends 36 of plate 24 as shown in FIG. 3. In other embodiments, recess portion 34 may be at any position along the length of plate 24. Furthermore, plate 24 may have a plurality of recess portions 34 positioned along the length of the plate.

As shown in FIG. 3, sides 30 of plate 24 angle downwardly and outwardly from top 26 to bottom 28. The ends 36 also angle downwardly and outwardly from top 26 to bottom 28. In an embodiment, sides 30 and ends 36 may angle perpendicularly (not shown) from top 26 to bottom 28. In addition to shield 10, binder metal 20 typically includes a trigger mechanism 38 located at one end of the shield 10, and extending beneath shield 10, for opening and closing rings 14, 16 and 18 (FIG. 1).

Figure 4:
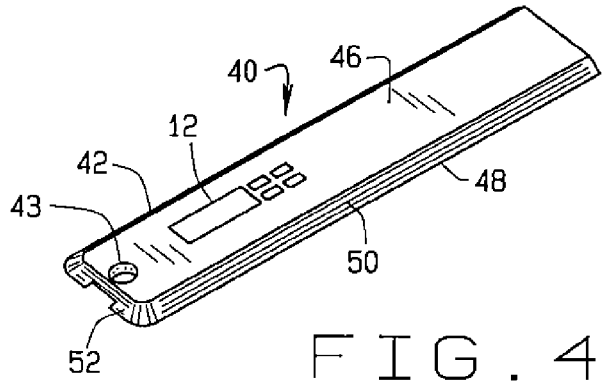
FIG. 4 illustrates a perspective view of a section of the insert that incorporates the accessory of FIG. 1.

Turning to FIG. 4, the present invention further comprises an insert 40 having a body 42 which is combined with accessory 12. In an embodiment, body 42 may comprise a soft pliable material. The accessory 12 may comprise a variety of objects to assist the user. For example, accessory 12 may include objects such as but not limited to writing implements, calculators, storage containers, notepads, indicia members and audio/video components. In addition, accessory 12 may also be integrally combined with body 42. Accordingly1 an accessory 12 such as a calculator may be partially embedded within body 42. An accessory 12 such as a storage container, though, may be removeably attached to body 42. Still further, an indicia member accessory 12 such as a corporate logo or school mascot design may be removably attached to body 42. The plate 24 and insert 40 (FIG. 4) may also include openings 43 to receive connectors (not shown) such as rivets which connect the shield 10 to the binder metal 20. The openings 39 provide clearance holes in the inserts 40 such that if the inserts 40 were attached to the binder metal 20 prior to being riveted or attached to the binder, the openings 39 would allow the rivets and rivet tool to pass through and allow for normal attachment to the binder.

As shown in FIG. 4, body 42 has a body top 46 and a body bottom 48 which may be wider and longer than body top 46. Body sides 50 angle downwardly and outwardly from body top 46 to body bottom 48. Body 42 further has body ends 52 which angle downwardly and outwardly from body top 46 to body bottom 48. In the embodiment, body sides 50 and body ends 52 may angle perpendicularly (not shown) from body top 46 to body bottom 48.

Figure 5:
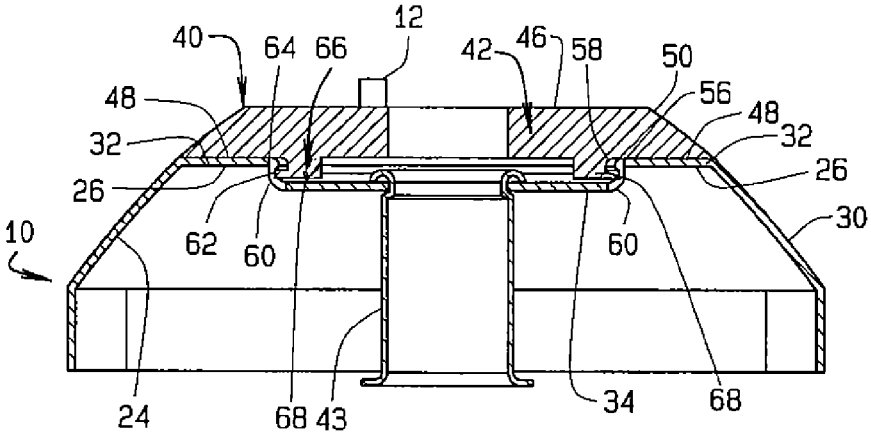
FIG. 5 is a cross sectional view showing the insert attached to the shield by a fastener.

Turning to FIG. 5, the ring shield 10 and insert 40 are shown in a cross sectional view. As shown, planar portions 32 have a groove 56 and a rib 58 which projects beyond groove 56 and into recess portion 34. The recess portion 34, meanwhile, has opposing recess walls 60 which are positioned adjacent to respective planar portions 32. Each recess wall 60 has a recess groove 62 and a recess rib 64. In an embodiment, recess rib 64 may project into the respective groove 56 of planar portion 32. The recess wall 60 may position recess rib 64 below and offset from rib 58 of planar portion 32.

As shown in FIG. 5, a fastener 66 removably attaches insert 40 to plate 24 such that body bottom 48 of insert 40 planarly abuts against top 26 of plate 24. In this position, body sides 50 angle outwardly from body top 46 to body bottom 48 at the same angle as sides 30 of plate 24 to position accessory 12 within binder rings 14, 16 and 18 (FIG. 1). Additionally, body ends 52 angle outwardly from body top 46 to body bottom 48. The fastener 66, which may be integrally formed with body bottom 48, has an extension 68 which projects beyond body bottom 48 and into recess portion 34. As shown, extension 68 projects under rib 58 and into recess groove 62 under pressure in order to attach the insert 40 to plate 24.

Since fastener 66 extends into the recess portion 34, body bottom 48 abuts flush against top 26 of plate 24. Accordingly, body 42 remains close to plate 24 to maximize the space within binder rings 14, 16 and 18 (FIG. 1) for the loose-leaf sheets. Furthermore, since body sides 50 angle outwardly at the same angle as sides 30 of top 26 when body bottom 48 planarly abuts against top 26, body sides 58 and sides 30 of plate 24 provide a uniform shape such as a slope which assists the user in manipulation of accessories 12. Still further, the openings 39 allow access to the connector, shown as a rivet.

Figure 6:
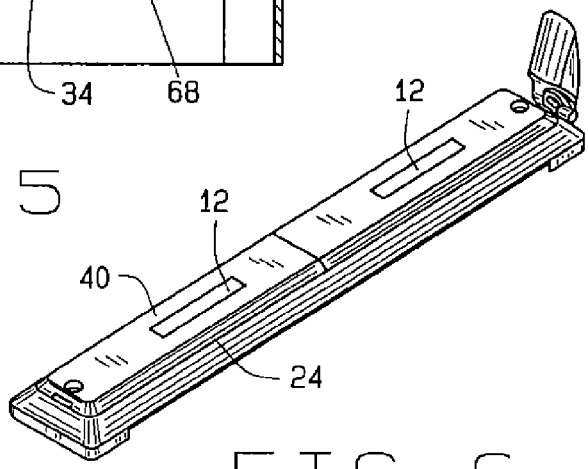
FIG. 6 is a perspective view of the insert attached to the shield by the fastener of FIG. 5.

Referring to FIG. 6 and referring to FIGS. 3 and 5, in operation, the user may position insert 40 over plate 24 to align fasteners 66 with recess portion 34 of plate 24. The user may then pressure fastener 66 into recess portion 34 by snapping extension 68 under rib 58 and into recess groove 62.

As shown in FIG. 6, insert 40 may comprise a plurality of inserts 40 removably attached to plate 24 to provide the user a variety of options for accessories 12. In this embodiment, fastener 66 of each insert 40 may removably attach to a common recess portion 34. The fasteners 66 of each insert 40 may also removably attach to separate recess portions 34 positioned along the length of plate 24. Accordingly, during use, the present disclosure provides multiple accessories 12 to be interchangeably placed by the plurality of inserts 40 to provide different working options from the accessories 12 for the user. Furthermore, an individual insert 40 may cover the entire length of plate 24.

Figure 7:
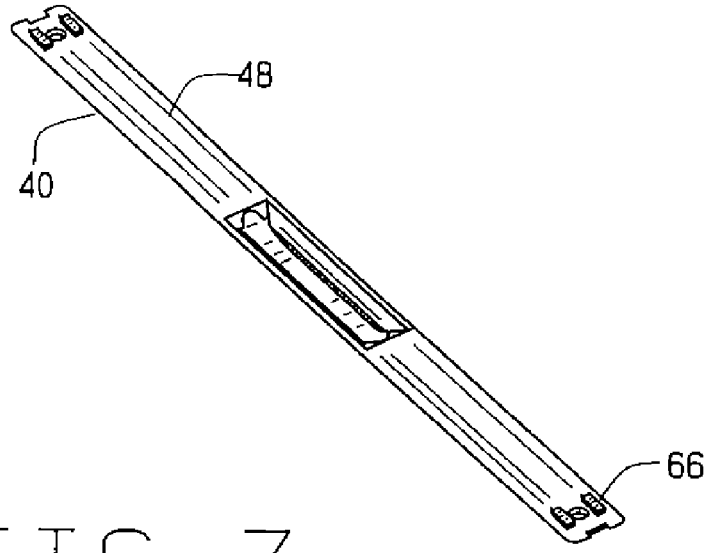
FIG. 7 is a perspective underside view the insert and fastener according to another embodiment of the invention.
Figure 8:
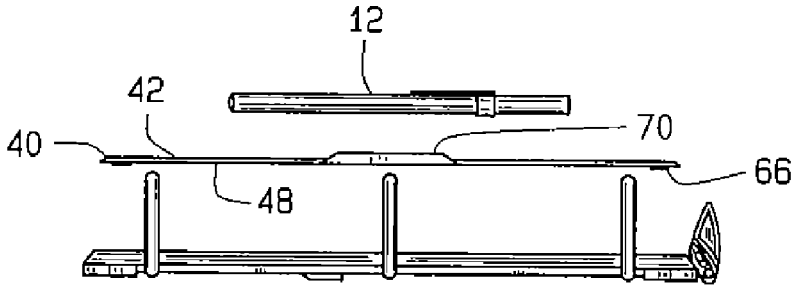
FIG. 8 is a side elevational view of the insert and the fastener of FIG. 7 and an accessory being positioned on the ring shield.
Figure 9:
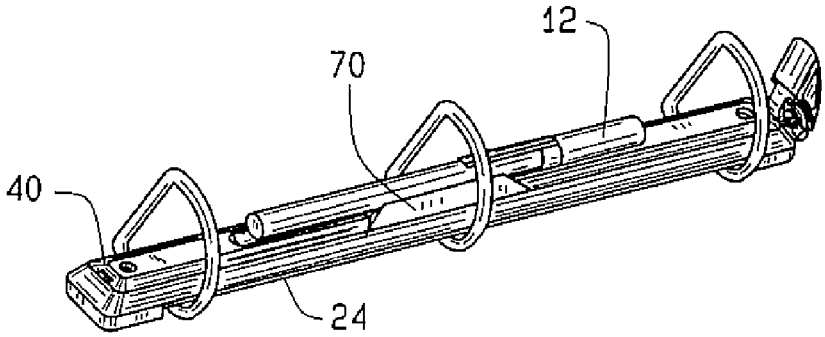
FIG. 9 is a perspective view of the accessory of FIG. 8 being attached to the ring shield.

Turning to FIGS. 7-9, another embodiment of the present invention illustrates insert 40 and fastener 66 as shown. In this embodiment, the fastener 66 comprises a magnet which attaches to body bottom 48 as shown in FIG. 7. Referring to FIG. 8, body 42 of insert 40 further comprises a channel 70 extending away from body top 46. The channel 70 positions and secures accessory 12, such as a writing implement, on insert 40. As shown in FIG. 9, the fastener 66 projects into recess portion 34 (FIG. 3) to magnetically attach insert 40 to plate 24 via recess portion 34. In this embodiment, channel 70 may not extend beyond accessory 12 to facilitate removal of accessory 12.

Figure 10:
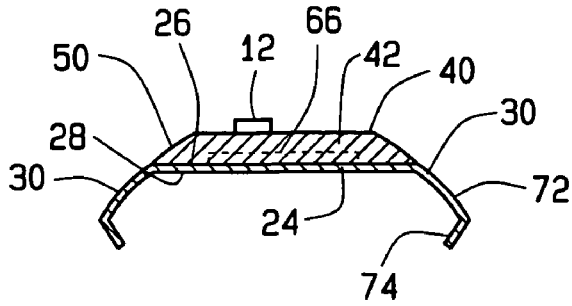
FIG. 10 is a cross sectional view of the ring shield, insert and fastener according to another embodiment of the invention.

Referring FIG. 10, another embodiment of the present invention illustrates another plate 24 wherein sides 30 extend from top 26 to bottom 28. Each side 30 includes a first side portion 72 and a second side portion 74 such that each first side portion 72 angles downwardly and outwardly with respect to top 26. Each second side portion 74 angles downwardly and inwardly with respect to top 26. As shown in FIG. 10, fastener 66 comprises a magnet which is embedded within body 42 of insert 40. The body 42 exposes a side of fastener 66 to top 26, wherein fastener 66 magnetically attaches body 42 to top 26 of plate 24.

Figure 11:
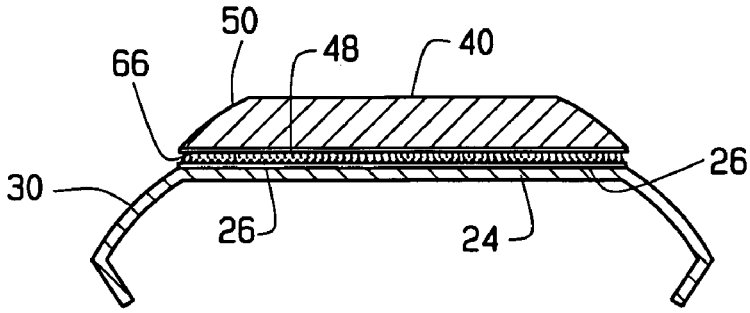
FIG. 11 is a cross sectional view of the ring shield, insert and fastener according to another embodiment of the invention.

Turning to FIG. 11, another embodiment of the present invention illustrates the plate 24 of FIG. 10. In this embodiment, fastener 66 may comprise a hook and loop fastener or an adhesive with fastener 66 removably attaching insert 40 to plate 24.

Figure 12:
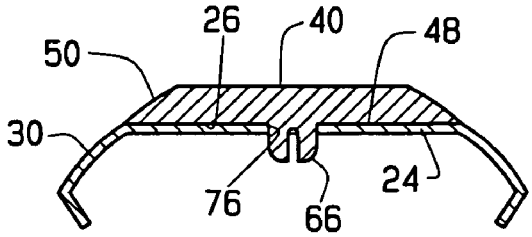
FIG. 12 is a cross sectional view of the ring shield, insert and fastener according to another embodiment of the invention; and, FIG. 13 is a cross sectional view of the ring shield and insert according to another embodiment of the invention.

Referring to FIG. 12, another embodiment of the invention illustrates plate 24 of FIG. 10. In this embodiment, the top 26 includes an aperture 76 extending through top 26. The fastener 66, which may be integrally formed from the body bottom 48, projects beyond the body bottom 48 and into aperture 76 positioned through top 26. In this embodiment, fastener 66 presses against aperture 76 to removably attach insert 40 to plate 24.

As shown in the embodiments of FIGS. 10-12, fastener 66 removably attaches insert 40 to plate 24 such that body bottom 48 planarly abuts against top 26 of plate 24. Since body bottom 48 abuts flush against top 26, body 42 remains close to plate 24 to maximize the space within the binder rings 14, 16 and 18 (FIG. 1) for the loose-leaf sheets. Furthermore, since body sides 50 angle outwardly at the same angle as sides 30 of top 26 when body bottom 48 planarly abuts against top 26, body sides 50 and sides 30 of plate 24 provide a uniform shape such as a slope which assists the user in manipulation of accessories 12.

Figure 13:
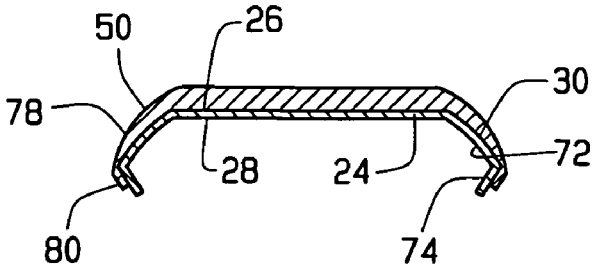

Turning to FIG. 13, another embodiment of the invention illustrates the plate 24 of FIG. 10. In this embodiment, sides 30 of plate 24 extend from top 26 to bottom 28 in which each side 30 includes first side portion 72 and second side portion 74. As shown, first side portion 72 angles downwardly and outwardly with respect to top 26 and second side portion 74 angles downwardly and inwardly with respect to top 26.

As shown, each body side 50 has a first body portion 78 and a second body portion 80 such that each first body portion 78 slideably covers the respective first side portion 72 and such that each second body portion 80 slideably overlays on the respective second side 74 portion to pressure insert 40 against plate 24.

In view of the above, it will be seen that the several objects of the disclosure are achieved and other advantageous results are obtained. As various changes could be made in the above constructions without departing from the scope of the disclosure, it is intended that all matter contained in the above description or shown in the accompanying drawings shall be interpreted as illustrative and not in a limiting sense.

Having thus described the invention, what is claimed and desired to be secured by Letters Patent is:

1. A ring shield for use in positioning an accessory within binder rings of a binder metal, comprising:

a plate having a length of which generally corresponds to the length of the binder metal, the plate having a top, a bottom, sides which connect the top and the bottom and ends which connect the top and the bottom, the top of the plate having opposing planar portions and a recess portion which separates the opposing planar portions, the recess portion having opposing walls formed adjacent to the respective planar portions with each wall having a recess groove and a recess rib;

an insert having a body which is combined with the accessory, the body having a top, a bottom, and sides which connect the top and the bottom, and the body having ends which connect the top and the bottom, the bottom of the body being wider and longer than the top thereof such that the sides angle outwardly from the top to the bottom at the same angle; and, a fastener which removably attaches the insert to the plate such that the body planarly abuts against the top of the plate to position the accessory within the binder rings.

2. The ring shield of claim 1 wherein the bottom is wider and longer than the top such that the sides angle outwardly from the top to the bottom and the ends angle outwardly from the top to the bottom.

3. The ring shield of claim 1 wherein the recess portion includes opposing recess walls which are positioned adjacent to respective planar portions in which each recess wall has a recess groove and a recess rib.

4. The ring shield of claim 3 wherein each recess rib projects into the respective groove of the planar portion.

5. The ring shield of claim 4 wherein the fastener is integrally formed with the body bottom of the insert.

6. The ring shield of claim 5 wherein the fastener has an extension which projects beyond the body bottom and into the recess portion.

7. The ring shield of claim 6 wherein the extension projects behind the rib and into the recess groove under pressure in order to removably attach the insert to the plate.

8. The ring shield of claim 7 wherein the recess portion is positioned on the top of the plate at a position which is equidistant from the ends of the plate.

9. The ring shield of claim 8 wherein the insert comprises a pair of bodies which removeably attach to the recess portion.

10. The ring shield of claim 1 wherein the fastener comprises a magnet which is embedded within the body of the insert and which is exposed to the top of the plate to magnetically attach the insert to the top of the plate.

11. The ring shield of claim 1 wherein the fastener is integrally formed with the body bottom and projects beyond the body bottom and into an aperture which is positioned through the top of the plate such that the fastener presses against the aperture to attach the insert to the plate.

12. The ring shield of claim 1 wherein the fastener comprises a magnet which attaches to the body bottom and which projects into and in contact with the recess portion to magnetically attach the insert to the plate.

13. A shield for use in a binder ring metal for positioning an accessory within binder rings of the metal, comprising:

a plate having a length of which generally corresponds to the length of the binder metal, the plate having a top, a bottom, and sides which connect the top and the bottom, the top of the plate having opposing planar portions and a recess portion which separates the opposing planar portions, the recess portion having opposing walls formed adjacent to the respective planar portions with each wall having a recess groove and a recess rib;

an insert having a body which is combined with the accessory; and, a fastener which removably attaches the insert to the plate such that the body planarly abuts against the top of the plate to position the accessory within the binder rings.

* * * * *